US006776153B1

(12) United States Patent
Walker et al.

(10) Patent No.: US 6,776,153 B1
(45) Date of Patent: Aug. 17, 2004

(54) HYBRID ATMOSPHERIC WATER HEATER

(76) Inventors: B. Keith Walker, 4834 S. 193 E. Ave., Broken Arrow, OK (US) 74014; Keith John Mundt, 4511 Shenandoah Rd., Rocklin, CA (US) 95765

( * ) Notice: Subject to any disclaimer, the term of this patent is extended or adjusted under 35 U.S.C. 154(b) by 0 days.

(21) Appl. No.: 10/386,309

(22) Filed: Mar. 11, 2003

(51) Int. Cl.[7] ..... F24H 1/10
(52) U.S. Cl. ..... 126/355.1; 126/350.1
(58) Field of Search ..... 126/355.1, 369.1, 126/359.1, 350.1; 122/31.1, 20 A, 31.2

(56) References Cited

U.S. PATENT DOCUMENTS

| | | | | | |
|---|---|---|---|---|---|
| 884,223 | A | * | 4/1908 | Shipley | 126/355.1 |
| 3,386,436 | A | * | 6/1968 | Miyahara | 126/355.1 |
| 3,648,682 | A | | 3/1972 | Bougard | |
| 3,826,240 | A | | 7/1974 | Miyahara | |
| 3,994,281 | A | * | 11/1976 | Godart | 126/350.1 |
| 4,275,708 | A | | 6/1981 | Wood | |
| 4,530,347 | A | | 7/1985 | Baker et al. | |
| 4,574,775 | A | | 3/1986 | Lutzen et al. | |
| 4,658,803 | A | | 4/1987 | Ball et al. | |
| 4,753,220 | A | | 6/1988 | Lutzen et al. | |
| 4,765,280 | A | | 8/1988 | Kobayashi et al. | |
| 5,168,861 | A | | 12/1992 | Lutzen et al. | |
| 5,520,165 | A | * | 5/1996 | Khinkis et al. | 126/355.1 |
| 2002/0190056 | A1 | | 12/2002 | Walker | |

* cited by examiner

*Primary Examiner*—James C. Yeung
(74) *Attorney, Agent, or Firm*—Molly D. McKay

(57) ABSTRACT

A high efficiency hybrid atmospheric water heater that employs direct and indirect contact of water and hot gases to achieve approximately 99% efficiency. The heater employs a large capacity combustion chamber to burn both liquid and gaseous fuel and achieving low nitrogen oxides ($NO_x$) emissions. The heater also employs exhaust tubes in combination with a unique receiver can, or alternately, candy cane shaped exhaust tubes, thereby eliminating expensive metal overheating associated with canopy covered exhaust tubes and preventing backpressure and associated sporadic burner performance, noise, and vibration. The heater employs two recirculation water nozzles for introducing water above the direct and indirect contact portions of the heater, depending on the temperature of the water to be recirculated.

7 Claims, 3 Drawing Sheets

HYBRID ATMOSPHERIC WATER HEATER

BACKGROUND OF THE INVENTION

1. Field of the Invention

The present invention relates to a high efficiency hybrid atmospheric water heater that overcomes many of the problems of current water heaters. Specifically, the present invention is capable of achieving approximately 99% efficiency, can be operated on a wide variety of fuel types, is capable of achieving low nitrogen oxides ($NO_x$) emissions, can be built to any size, operates with consistent burner performance and low noise and vibration, and is constructed of economical materials.

2. Description of the Related Art

Applicant's water heater is a combination of a direct contact water heater, i.e. a water heater where the combustion gases come into direct contact with the water that is being heated, and an indirect contact water heater, i.e. a water heater where the combustion gases are contained within a combustion chamber and exhaust tubes and do not come into direct contact with the water that is to be heated which is located on an opposite side of the combustion chamber wall and on an outside surface of the exhaust tubes.

The present invention combines a direct contact water heater portion and an indirect contact water heater portion to create a new and better type of water heater. Current water heater designs have three areas where improvement can be made. These areas where improvement is needed are in the location of the water inlet, the design of the combustion chamber, and the exit of the exhaust tubes.

The first problem with current water heater designs is in the location of the water inlet. The optimum location for the makeup water inlet in a direct contact water heater is at the top of the unit. By adding the cooler makeup water at the top of the unit, maximum heat exchange can occur between the downwardly cascading makeup water and the upwardly flowing combustion gases. Water heaters with the makeup water inlet located at the bottom of the unit are less efficient, able to achieve only approximately 91% efficiency as compared to approximately 99% heat transfer efficiency in the present invention.

Although makeup water to the heater is introduced through the makeup water inlet, the present invention is also provided with a separate water recirculation inlet at the top of the indirect contact water portion. This water recirculation inlet is for recirculating water within the lower indirect contact portion of the water heater whenever the temperature of the water to be reheated is greater than or equal to 150 degrees Fahrenheit. In the case of recirculation water temperatures that are less than 150 degrees Fahrenheit, the recirculation water is distributed by the upper makeup water inlet along with any makeup water that is needed.

Prior art water heaters teach a single water distribution location for water to be heated. This single water distribution location on prior art water heaters is always located at the top of the heating tower for both cold makeup water and for hotter recirculation water. Entry of hotter recirculation water to the upper portion of the water heaters, i.e. the direct contact portion, creates a high degree of vaporization of the distributed water stream. This vaporization cools down the water stream, making the overall efficiency of water heaters that move hotter recirculation water up to the top portions of the unit, i.e. the direct contact portion, lower than can be achieved when limiting the flow of hotter recirculation waters only to the lower sections, i.e. the indirection contact portions.

The second problem with current water heater designs is in the design of their combustion chamber. Prior art water heaters with the combustion chamber under the water line employ as their combustion chamber either a small diameter immersion tube or open bottom atmospheric combustion burner box instead of the large diameter, forced draft, firing chamber of the present invention. Both the small diameter firing tube and the open bottom atmospheric burner limit the amount of energy that can be burned to approximately 3 million BTUs/hr., thereby limiting the size of the water heater that can be produced when it employs one of these two types of combustion chamber. The present invention, on the other hand, employs a large diameter firing chamber that does not limit the size of the water heater unit with which it is employed. The present invention employs a forced draft combustion burner which allows efficient and clean combustion of liquid fuels. In addition to giving clean, efficient combustion, the firing chamber is large enough to allow the flame to be fully developed without impinging on any wall structure of the fire box. The combustion chamber of the present invention allows for adequate combustion space to burn large BTU energy releases of either gaseous or liquid fuels. Also, because the combustion chamber is circular when viewed from a top perspective, this makes the fire box more economical to produce than the square and rectangular prior art fire boxes and also minimizes the creation of thermal hot spots that produce $NO_x$, thus making the present invention a lower $NO_x$ producing device than prior art rectangular fire box designs.

Also, both a small diameter firing tube and an open bottom atmospheric burner are not designed to produce low $NO_x$ emissions at the concentration of 20 ppm or less. Therefore, a water heater employing either of these two types of combustion chambers could not be used in California or Texas or anywhere that is designated by the EPA as a non-attainment zone and requiring 20 ppm $NO_x$ or less. The present invention, in contrast, is able to achieve low $NO_x$ emissions less than 20 ppm due to its use of a larger diameter firing chamber.

In addition, both a small diameter firing tube and an open bottom atmospheric burner can only be used with gaseous fuels, and neither can be employed with fuel oil or other combustible liquid fuel. The inability to burn oils severely limits the use of water heaters with these two types of combustion chambers, particularly in the eastern states in the United States and in foreign countries both of which are heavily dependent on liquid heating fuels. The present invention does not have this limitation because its large diameter firing chamber can easily burn either gaseous or liquid fuel sources. The large diameter firing chamber of the present invention has a plurality of exhaust tubes as the only exit out of the chamber for combustion gases.

The third problem with current water heater designs is in the exit of the exhaust tubes. Current gas fired water heaters, such as for example the one taught in U.S. Pat No. 4,658,803 to Ball et al., employ an overhead canopy or cover above the exit of the exhaust tubes. The purpose of the overhead canopy is to prevent water from entering the exhaust tubes. Exhaust tubes which have an overhead canopy experience two problems: overheating of the dry portion of the metal tubes located above the water line and below the canopy and sporadic backpressure created by a water curtain that is created by the canopy. Also the cost of manufacturing units with canopy style designs is higher than production of the present invention.

The immediate metal surfaces of the metal tubes, i.e. those portions of the metal tubes that are located above the water contained in the water chamber which surrounds the tubes and also located under the canopy where falling water cannot contact their exterior surfaces, remain dry and tend to overheat since they are not cooled by contact with the water. This results in overheating of the metal tubes and possible metal failure or at least greatly reduced tube life. One solution to this problem is to add an elaborate water cooling system to cool this portion of these metal tubes, however this type of cooling system is expensive to manufacture.

The solution that is normally employed to address this problem is to utilize expensive metal, i.e. special steel, which is capable of withstanding the elevated temperatures when manufacturing those dry portions of the metal tubes. Because of the expense of this special high temperature metal, in order to reduce costs, the tubes are generally produced in two sections, i.e. a lower wet section and an upper dry section. The lower wet section is constructed of less expensive metal since this section has the advantage of being contacted with water which dissipates heat from the wet surface. The upper dry section is constructed of the more expensive high temperature metal to withstand the high temperatures that result because this section is not cooled by water contact. However, use of two types of metals requires a splice or junction between the two sections which can be another place where leakage and metal failure can occur.

The present invention addresses this problem by employing an exhaust collector can into which the exhaust tubes attach at their exit. The exhaust tubes terminate into the exhaust collector can that allows for the exit of exhaust gases and also allows water to contact all exterior surfaces of the exhaust tubes and the exhaust collector can. Cascading water being sprayed either from the makeup water inlet or the recirculation inlet cools the metal, yet the exhaust collector still prevents water from entering the exhaust tubes. Thus because none of the metal surfaces experience extreme temperatures, the present invention can be constructed of lower cost metals, thereby keeping the construction cost low for this invention.

An alternate embodiment of the present invention employs a "candy cane" shape to the exhaust tubes instead of terminating the exhaust tubes in an exhaust collector can. Like the use of an exhaust collector can, use of exhaust tubes with a u shaped downwardly opening exit benefits from allowing all of the exhaust tube surfaces to be wet and creating natural pathways for air flow out of the tubes, thereby preventing the creation of back pressure pockets.

Still another problem with the use of a canopy located above the exit of the tubes is that this arrangement causes a continuous water curtain to be formed around the tubes where the water cascades over the canopy and falls unimpeded downward to the water surface of the water located in the water chamber that surrounds the tubes. Exhaust gases that exit the tubes are trapped under the water curtain until sufficient back pressure is created in the tubes and in the combustion chamber to blow the combustion gases through the water curtain. The resulting sporadic backpressure and periodic relief thereof causes inconsistent burner performance, and causes undesirable noise to emanate from the heater and causes destructive vibration within the water heater unit.

Space provided around the bottom of the exhaust collector can and between the tubes in the present invention creates natural air flow paths for exhaust gas to exit the collector can, thereby preventing buildup of backpressure and the resulting problems associated with creation and release of that backpressure.

SUMMARY OF THE INVENTION

The present invention is a hybrid atmospheric water heater that combines portions of a direct contact water heater and an indirect contact water heater within an outer shell to form a more efficient water heater.

The water heater is provided with an upper direct contact portion and a lower indirect contact portion. Makeup water or recirculation water that is less than 150 degrees Fahrenheit is introduced into the upper direct contact portion, and cooled exhaust gases exit the unit in the upper direct contact portion. A lower indirect contact portion is provided immediately underneath the upper direct contact portion. Below the lower direct contact portion, fuel is burned in a combustion chamber and exhaust tubes pass the hot combustion gases out of the combustion chamber through a water filled compartment of the indirect portion to the bottom of the direct contact portion of the heater. A burner fueled by either liquid or gaseous fuel fires into the large diameter combustion chamber. The combustion chamber is preferably provided with a fire wall that is either insulated with refractory or is alternately provided with a liquid cooled shell.

Indirect heat exchange occurs between the hot combustion gases and water located in the indirect or first heat transfer zone via a bottom plate that separates the combustion chamber from the water filled first heat transfer zone and via the exhaust tubes. The first heat transfer zone is the water compartment that surrounds the exhaust tubes. This water compartment is partially filled with water so that a lower portion of the exhaust tubes are constantly covered with water.

In addition to the indirect heat exchange that occurs through the bottom plate and the exhaust tubes, indirect heat exchange also occurs between the exhaust collector can into which the exhaust tubes exit and water that cascades down over the tubes and can. This cascading water comes from one of two sources. It either comes from the second heat transfer zone located directly above the first heat transfer zone, or alternately, when the second heat transfer zone is not in use, i.e. when the recirculation water to be heated is at or above 150 degrees Fahrenheit, the cascading water comes from recirculation water that cascades down over the tubes and can from a recirculation water spray nozzle provided on a water recirculation line.

The recirculation water spray nozzle receives water via a water pump from the bottom of the first heat transfer zone when the second heat transfer zone is not in use. Alternately, water drawn out of the bottom of the first heat transfer zone can be recirculated to a makeup water spray nozzle located at the top of the second heat transfer zone or pumped out of the unit for use. The makeup water spray nozzle also receives fresh makeup water via a makeup water line.

In an alternate embodiment, instead of employing a collection can at the exit of the exhaust tubes, alternate exhaust tubes are employed each of which is shaped in the form of a candy cane. In these alternate exhaust tubes, the exit for each tube is located in a shorter, downwardly extending portion of the candy cane-shaped exhaust tube.

Water from the makeup water spray nozzle cascades over a packed bed of heat exchange elements. The heat exchange elements facilitate heat transfer between the downwardly flowing water and the upwardly traveling exhaust gases. The exhaust gases exit the first heat transfer zone via exhaust tubes and the attached exhaust collector can, or alternately, via the alternate candy cane-shaped exhaust tubes.

Then, the exhaust gases enter the second heat transfer zone from the first heat transfer zone via a perforated packing shelf that separates the first and second heat transfer zones within the water heater. The heat exchange elements are supported by and prevented from entering the first heat exchange zone by the perforated packing shelf. However, the perforations in the perforated packing shelf freely allow water to pass downwardly through the shelf from the second heat exchange zone into the first heat exchange zone and also allow hot exhaust gases to pass upwardly through the shelf from the first heat exchange zone into the second heat exchange zone.

DETAILED DESCRIPTION OF THE PREFERRED EMBODIMENT

The Invention

Figure 1:
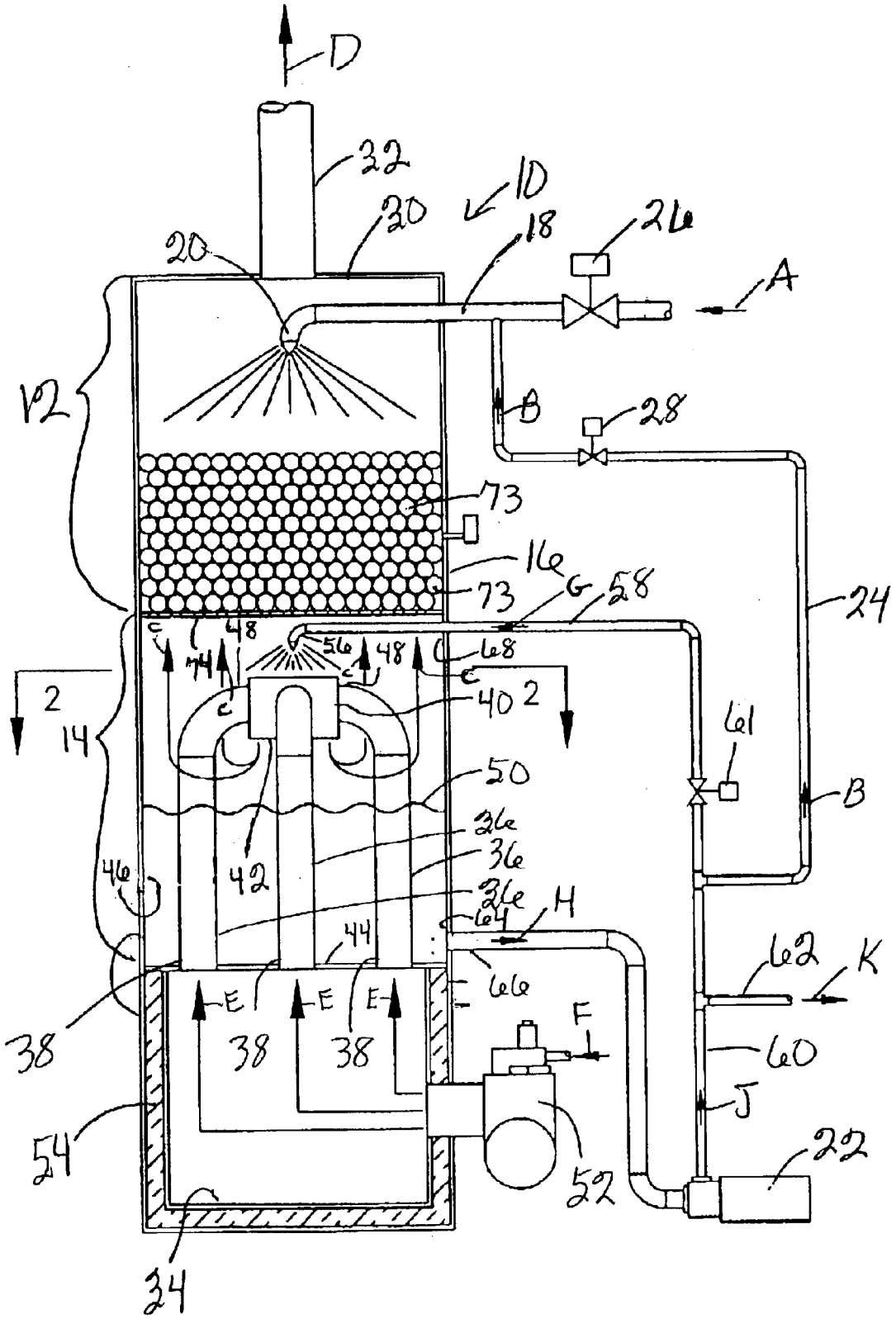
FIG. 1 is a side view of a hybrid atmospheric water heater constructed in accordance with a preferred embodiment of the present invention.

Referring now to the drawings and initially to FIG. 1, there is illustrated a hybrid atmospheric water heater 10 constructed according to a preferred embodiment of the present invention. The water heater 10 combines a direct contact water heater portion 12 and an indirect contact water heater portion 14 within an outer shell 16 to form the more efficient water heater 10.

The upper direct contact portion 12 is located immediately above the lower indirect contact portion. Makeup water, shown by arrow A, enters the heater 10 via a makeup water line 18 that is provided with a makeup water spray head or nozzle 20 that sprays the water into the upper direct contact portion 12 of the heater 10.

Alternately, cool recirculation water that is less than 150 degrees Fahrenheit, shown by arrow B, can be recirculated by introducing it into the upper direct contact portion 12 via the makeup water line 18 and the makeup water spray nozzle 20. The cool recirculation water is supplied to the makeup water line 18 from a water pump 22 via a cool recirculation line 24. Flow of the makeup water is controlled by makeup water supply valve 26 provided in the makeup water line 18, and flow of the cool recirculation water is controlled by a cool recirculation water valve 28 provided in the cool recirculation line 24.

Water from the makeup water spray head 20 cascades down through the direct contact portion 12 as hot exhaust gases, as shown by arrows C, come from the indirect contact portion 14 and move upward through the direct contact portion 12. When the exhaust gases reach the top 30 of the direct contact portion 12, they have cooled, and the cooled exhaust gases, shown by arrow D, exit the heater 10 at an exhaust gas exit 32 provided in the outer shell 16 at the top 30 of the upper direct contact portion 12.

The lower indirect contact portion 14 is provided immediately underneath the upper direct contact portion 12 within the shell 16, and a circular, large diameter combustion chamber 34 is located immediately underneath the indirect contact portion 14 within the shell 16.

Either liquid or gaseous fuel is burned in the large diameter, circular combustion chamber 34. Several exhaust tubes 36 are provided, with each exhaust tube 36 attached to the combustion chamber 34 on its lower end 38. Hot combustion gases, as shown by arrows E, pass from the combustion chamber 34 into the exhaust tubes 36, then through the exhaust tubes 36 into an exhaust collector can 40. The exhaust collector can 40 is provided with an open bottom 42 so that the hot combustion gases can pass out of the can 40 and then flow upward out of the indirect contact portion 14 of the heater 10, as illustrated by arrows C.

The combustion chamber 34 is provided with a plate 44 that separates it from a partially filled water compartment 46 of the indirect contact portion 14 that is located immediately above the combustion chamber 34. The exhaust tubes 36 extend through the plate 44 so that there is direct communication between the combustion chamber 34 and the exhaust tubes 36, but water from the water compartment 46 does not enter the exhaust tubes 36 or the combustion chamber 34. The exhaust tubes 36 pass through water contained in the partially filled water compartment 46 provided in the indirect contact portion 14 of the heater 10 so that an upper curved end 48 of each exhaust tube 36 extends above the water level 50 in the water compartment 46.

A burner 52 fueled by either liquid or gaseous fuel fires a mixture of air and fuel, as indicated by arrow F, into the large diameter combustion chamber 34 where the fuel is burned, producing heat and the hot combustion or exhaust gases. The combustion chamber 34 is preferably provided with a fire wall 54 that is either insulated with refractory, or, alternately, provided with a liquid cooled shell.

Heat exchange first occurs between the hot combustion gases and water in the indirect contact portion which is also referred to hereafter as the first heat transfer zone 14. This indirect heat exchange occurs via the plate 44 that separates the combustion chamber 34 from the partially water filled water compartment 46 and via the exhaust tubes 36. The water compartment 46 of the first heat transfer zone 14 is partially filled with water so that the water surrounds and constantly covers the lower ends 38 of the exhaust tubes 36.

In addition to the indirect heat exchange that occurs through the plate 44 and the exhaust tubes 36, in a preferred embodiment of the present invention, indirect heat exchange also occurs between the exhaust collector can 40 into which the exhaust tubes 36 exit and the water that cascades down over the tubes 36 and can 40. This cascading water comes either from water that has dropped from the direct contact portion 12 of the heater 10 located directly above the first heat transfer zone 14, or alternately, from recirculation water that cascades down over the tubes 36 and the can 40 from a recirculation water spray nozzle 56 provided on a hot water recirculation line 58 when the direct contact portion 12 is not in use, i.e. when the recirculation water to be heated is at or above 150 degrees Fahrenheit. The direct contact portion will hereafter be referred to as the second heat transfer zone 12.

As shown by arrow G, the recirculation water spray nozzle 56 receives water from the hot water recirculation line 58 which is connected to the water pump 22 via a common water line 60. Flow of the hot recirculation water is controlled by a hot recirculation water valve 61 provided in the hot recirculation line 58.

In addition, the common water line 60 also supplies recirculation water from the water pump 22 to the cool recirculation water line 28 when the second heat transfer zone 12 is in use due to the low temperature of the water being recirculated within the water heater 10. The common water line 60 also supplies heated water for use via a hot water delivery line 62, as shown by arrow K.

As shown by arrow H, the water pump 22 receives heated water from the bottom 64 of the water compartment 46 in the first heat transfer zone 14 via a water outlet line 66 and pumps the water, as shown by arrow J, into a common water line 60. Thus, water drawn out of the bottom 64 of the first heat transfer zone 14 can be recirculated to the a makeup water spray nozzle 20 located at the top 30 of the second heat transfer zone 12, can be recirculated to the hot recirculation spray nozzle 56 located at the top 68 of the first heat transfer zone 14, or can be pumped out of the heater 10 via the hot water delivery line 62 for use. The makeup water spray nozzle 20 also receives fresh makeup water via the makeup water line 18.

Figure 4:
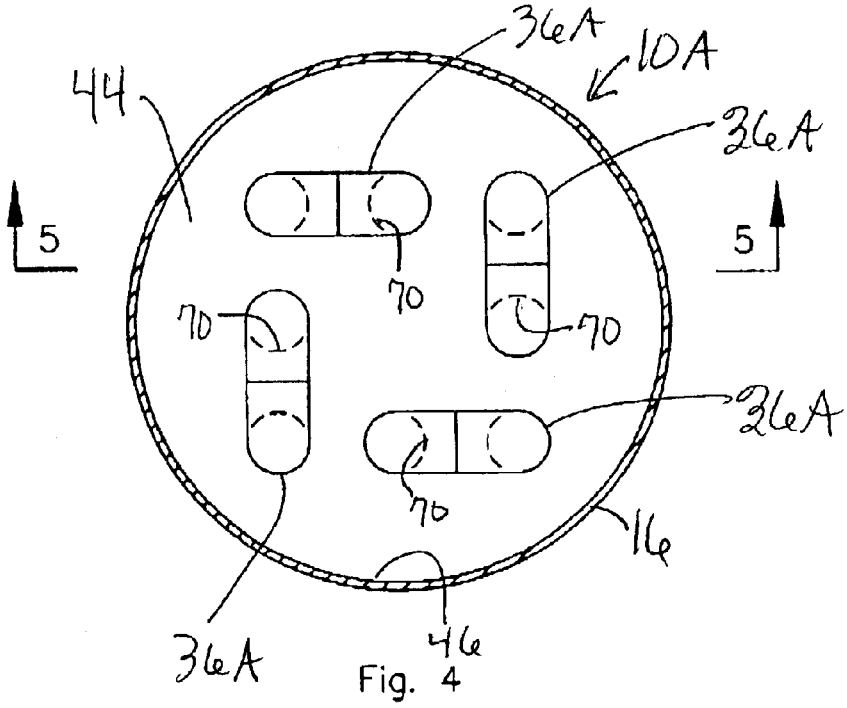
FIG. 4 is a cross sectional view of an alternate embodiment taken along a section similar to the one shown in FIG. 2.
Figure 5:
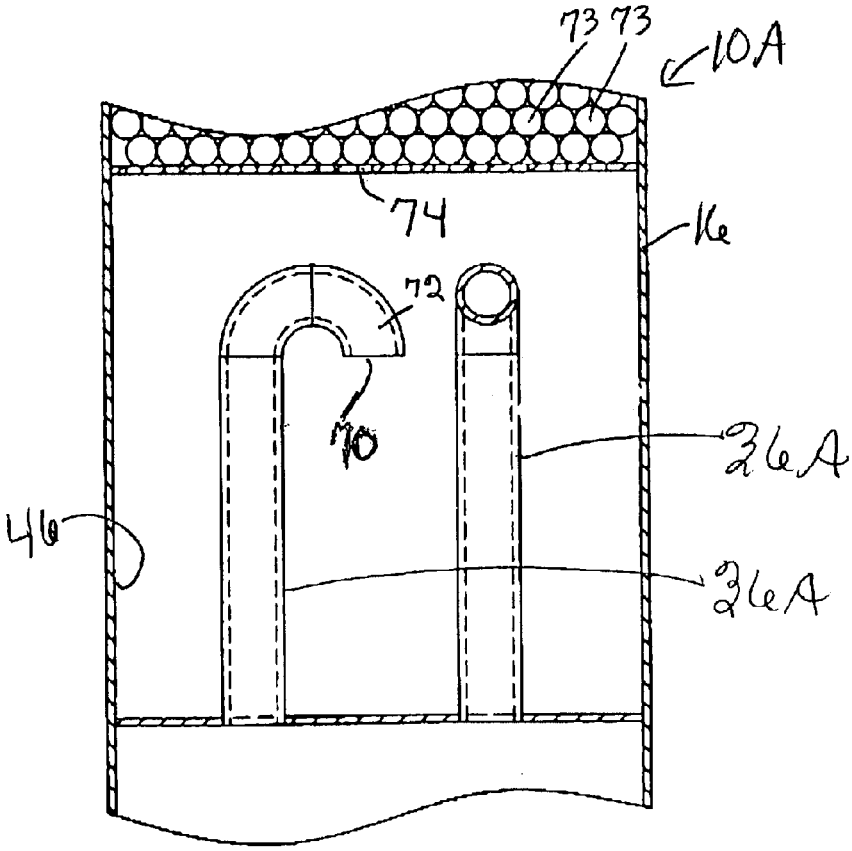
FIG. 5 is a cross section view taken along line 5—5 of FIG. 4.

As illustrated in the alternate embodiment water heater 10A shown in FIGS. 4 and 5, alternate exhaust tubes 36A can be substituted for the exhaust tubes 36 and the collection can 40 previously described for the preferred embodiment heater 10. Instead of employing a collection can 40 at the upper ends 48 of the exhaust tubes 36, alternate exhaust tubes 36A which are each shaped in the form of a candy cane are employed. In these alternate exhaust tubes 36A, the exit 70 for each alternate tube 36A is located in a shorter, downwardly extending end 72 of the candy cane-shaped alternate exhaust tube 36A. All other features of the alternate embodiment water heater 10A are the same as for the preferred embodiment water heater 10.

Figure 2:
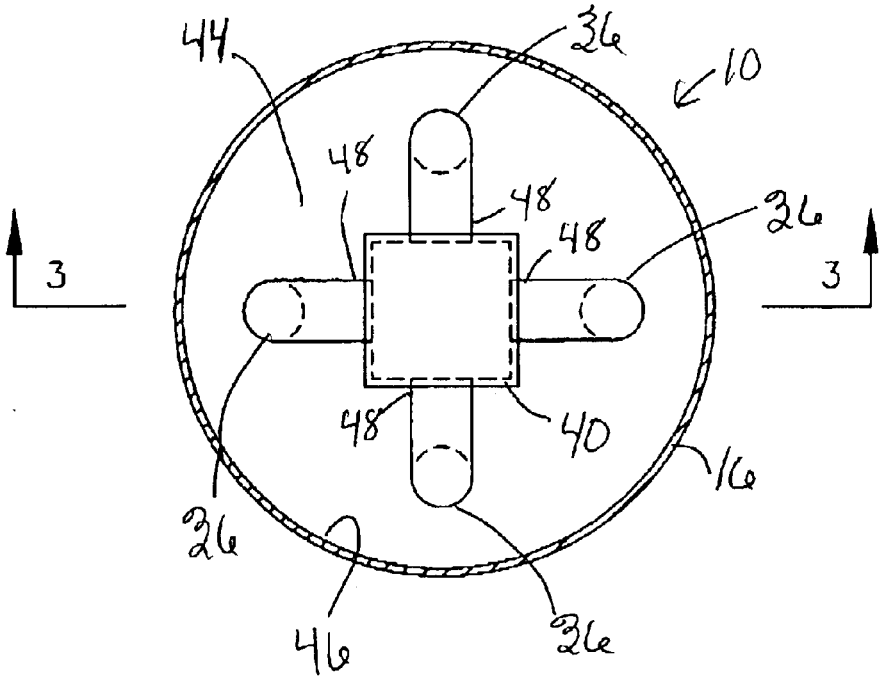
FIG. 2 is a cross sectional view taken along line 2—2 of FIG. 1.
Figure 3:
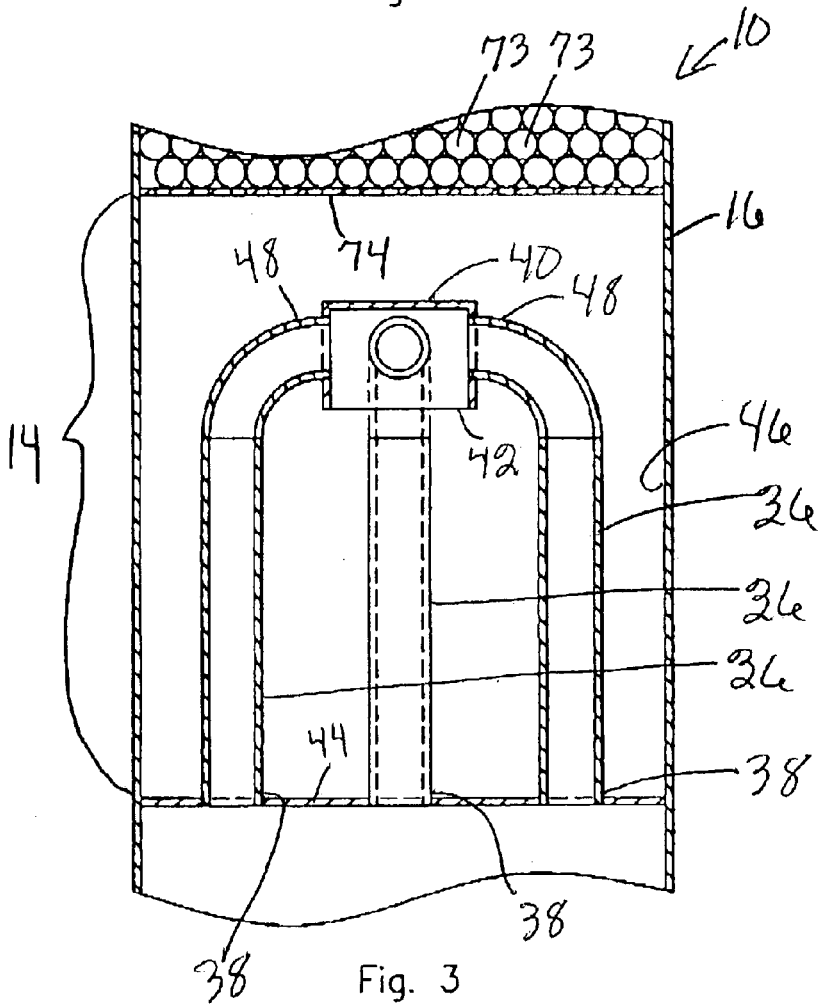
FIG. 3 is a cross sectional view taken along line 3—3 of FIG. 2.

Referring now again to the preferred embodiment water heater 10 illustrated in FIGS. 1–3, water from the makeup water spray nozzle 20 cascades over the second heat transfer zone 12 which preferably consists of a packed bed of heat exchange elements 73 that have high surface area and thereby facilitate heat transfer between the relatively cool, downwardly flowing water and the relatively hot, upwardly flowing exhaust gases. The exhaust gases exit the first heat transfer zone 14 via the exhaust tubes 36 and the attached exhaust collector can 40, or alternately, in the case of the alternate embodiment 10A show in FIGS. 4–5, via alternate candy cane-shaped exhaust tubes 36A. In both embodiments 10 and 10A, the exhaust gases next enter the second heat transfer zone 12 from the first heat transfer zone 14 via a perforated packing shelf 74 that separates the first and second heat transfer zones 14 and 12 within the water heater 10 or 10A. The heat exchange elements 73 are supported within the second heat exchange zone 12 by and prevented from entering the first heat exchange zone 14 by the perforated packing shelf 74. However, the packing shelf 74 is provided with perforations therein which freely allow water to pass downwardly through the shelf 74 from the second heat exchange zone 12 into the first heat exchange zone 14 and also allow hot exhaust gases to pass upwardly through the shelf 74 from the first heat exchange zone 14 into the second heat exchange zone 12.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A hybrid atmospheric water heater comprising:

an outer shell for a water heater, a direct contact water to exhaust gas portion provided within the outer shell, an indirect contact water to exhaust gas portion provided within the outer shell, a large diameter combustion chamber provided within the outer shell, the direct contact portion located at the top of the outer shell, the combustion chamber located at the bottom of the outer shell, the indirect contact portion located between the direct contact portion and the combustion chamber, exhaust tubes extending through a water compartment of the indirect contact portion, a plate separating the water compartment and the combustion chamber, a lower end of each exhaust tube extending through the plate so that hot exhaust gases pass from the combustion chamber through the exhaust tubes, said lower end of each exhaust tube extending under a water level of water contained within the water compartment, an upper end of each exhaust tube being open to allow the hot exhaust gases to exit the tube, water cascading over the outside of the tubes into the water compartment, the upper ends of each tube extending into an exhaust collection can, and said exhaust collection can having an opening bottom through which the hot exhaust gases exit the can and travel upward into the direct contact portion.

2. A hybrid atmospheric water heater comprising:

an outer shell for a water heater, a direct contact water to exhaust gas portion provided within the outer shell, an indirect contact water to exhaust gas portion provided within the outer shell, a large diameter combustion chamber provided within the outer shell, the direct contact portion located at the top of the outer shell, the combustion chamber located at the bottom of the outer shell, the indirect contact portion located between the direct contact portion and the combustion chamber, exhaust tubes extending through a water compartment of the indirect contact portion, a plate separating the water compartment and the combustion chamber, a lower end of each exhaust tube extending through the plate so that hot exhaust gases pass from the combustion chamber through the exhaust tubes, said lower end of each exhaust tube extending under a water level of water contained within the water compartment, an upper end of each exhaust tube being open to allow the hot exhaust gases to exit the tube, water cascading over the outside of the tubes into the water compartment, and each exhaust tube being candy cane shaped so that the upper ends face downward and prevent water from entering the tube.

3. A hybrid atmospheric water heater comprising:

an outer shell for a water heater, a direct contact water to exhaust gas portion provided within the outer shell, an indirect contact water to exhaust gas portion provided within the outer shell, a large diameter combustion chamber provided within the outer shell, the direct contact portion located at the top of the outer shell, the combustion chamber located at the bottom of the outer shell, the indirect contact portion located between the direct contact portion and the combustion chamber, exhaust tubes extending through a water compartment of the indirect contact portion, a plate separating the water compartment and the combustion chamber, a lower end of each exhaust tube extending through the plate so that hot exhaust gases pass from the combustion chamber through the exhaust tubes, said lower end of each exhaust tube extending under a water level of water contained within the water compartment, an upper end of each exhaust tube being open to allow the hot exhaust gases to exit the tube, water cascading over the outside of the tubes into the water compartment, and wherein the water cascading over the outside of the tubes into the water compartment is water that originated from a means for introducing recirculation water that is provided at the top of the indirect contact portion.

4. A hybrid atmospheric water heater comprising:

a direct contact portion, an indirect contact portion provided under the direct contact portion, a large diameter combustion chamber provided under the indirect contact portion, a water inlet provided above the direct contact portion for supplying water to both the direct and indirect contact portions, and a water outlet line provided at the bottom of the indirect contact portion, said water outlet line attached to hot water delivery line for supplying hot water for use, said water outlet line attached to a cool water recirculation line that provides water to the water inlet when the water is less than 150 degrees Fahrenheit and not needed for use, said water outlet line attached to a hot water recirculation line that provides water to a second water inlet provided at the top of the indirect contact portion when the water is at or above 150 degrees Fahrenheit and not needed for use.

5. A hybrid atmospheric water heater comprising:

a direct contact portion, an indirect contact portion provided under the direct contact portion, a large diameter combustion chamber provided under the indirect contact portion, a water inlet provided above the direct contact portion for supplying water to both the direct and indirect contact portions, and exhaust tubes provided within the indirect contact portion for channeling hot exhaust gas from the combustion chamber through the indirect contact portion and out the exhaust tubes at the top of the indirect contact portion, said exhaust tubes shaped so that all exterior surfaces of said exhaust tubes are contacted by downward cascading water without allowing cascading water to enter the exhaust tubes.

6. A hybrid atmospheric water heater comprising:

exhaust tubes provided within the indirect contact portion for channeling hot exhaust gas from the combustion chamber through the indirect contact portion and out the exhaust tubes at the top of the indirect contact portion, said exhaust tubes shaped so that all exterior surfaces of said exhaust tubes are contacted by downward cascading water without allowing cascading water to enter the exhaust tubes, a direct contact portion, an indirect contact portion provided under the direct contact portion, a large diameter combustion chamber provided under the indirect contact portion, a water inlet provided above the direct contact portion for supplying water to both the direct and indirect contact portions, and the exhaust tubes are candy shaped so that the exit is downwardly oriented.

7. A hybrid atmospheric water heat according to claim 5 wherein the upper end of each exhaust tube attaches to an open bottom exhaust collection can.

* * * * *